US005209142A

United States Patent [19]

Dickson

[11] Patent Number: 5,209,142

[45] Date of Patent: May 11, 1993

[54] ASSIST-A-TWIST

[76] Inventor: Kenneth C. Dickson, 11 Japonica Crescent, Brantford, Ontario, Canada, N3R-1N5

[21] Appl. No.: 830,187

[22] Filed: Jan. 31, 1992

[30] Foreign Application Priority Data

Jan. 17, 1990 [CA] Canada ..... 2008011

[51] Int. Cl.[5] ..... B67B 7/00

[52] U.S. Cl. ..... 81/3.32; 81/3.39; 81/3.42

[58] Field of Search ..... 81/3.07, 3.25, 3.31, 81/3.32, 3.39, 3.4, 3.42

[56] References Cited

U.S. PATENT DOCUMENTS

| | | | |
|---|---|---|---|
| 901,618 | 10/1908 | Honstein | 81/3.32 |
| 1,260,157 | 3/1918 | Denton | 81/3.32 |
| 1,550,827 | 8/1925 | Lauber | 81/3.32 |
| 1,906,887 | 5/1933 | Rogers | 81/3.32 |
| 2,535,210 | 12/1950 | Jackson | 81/3.32 |
| 2,897,699 | 8/1959 | Anderson, Jr. | 81/3.32 |
| 4,102,226 | 7/1978 | McGuire | 81/3.32 |

*Primary Examiner*—Roscoe V. Parker

[57] ABSTRACT

A device to securely hold a container, (produced from any currently known material) utilizing the user's body weight for pressure, exerted by leaning against the device. This action enables a disabled or weakened person to twist, puncture or pry off the top, or portion thereof, with either one good hand or two crippled hands.

2 Claims, 2 Drawing Sheets

ASSIST-A-TWIST

This invention relate to the removal of lids from containers when a person is restricted to the use of one hand or has an ailment limiting the combined strength of both hands. Tools available on the market today address the removal of container lids only. None of the tools deal with holding the container with no hands, because it is assumed that one hand will hold the container while the other hand uses the tool to open it, twist the lid off, or pull off the tab.

The primary intention of this invention is to hold containers while removing the lids; however it can also be used as a holder for any object falling within the physical restrictions of the clamping apparatus, allowing both hands to remain free for working on the object.

The drawings indicate dimensions which encompass most articles encountered around a household; however, this patent application reserves the right to increase or decrease the physical size as required, but the principle will remain the same.

The following is a description of how the device functions, referring to drawings attached for clarification:

Figure 1:
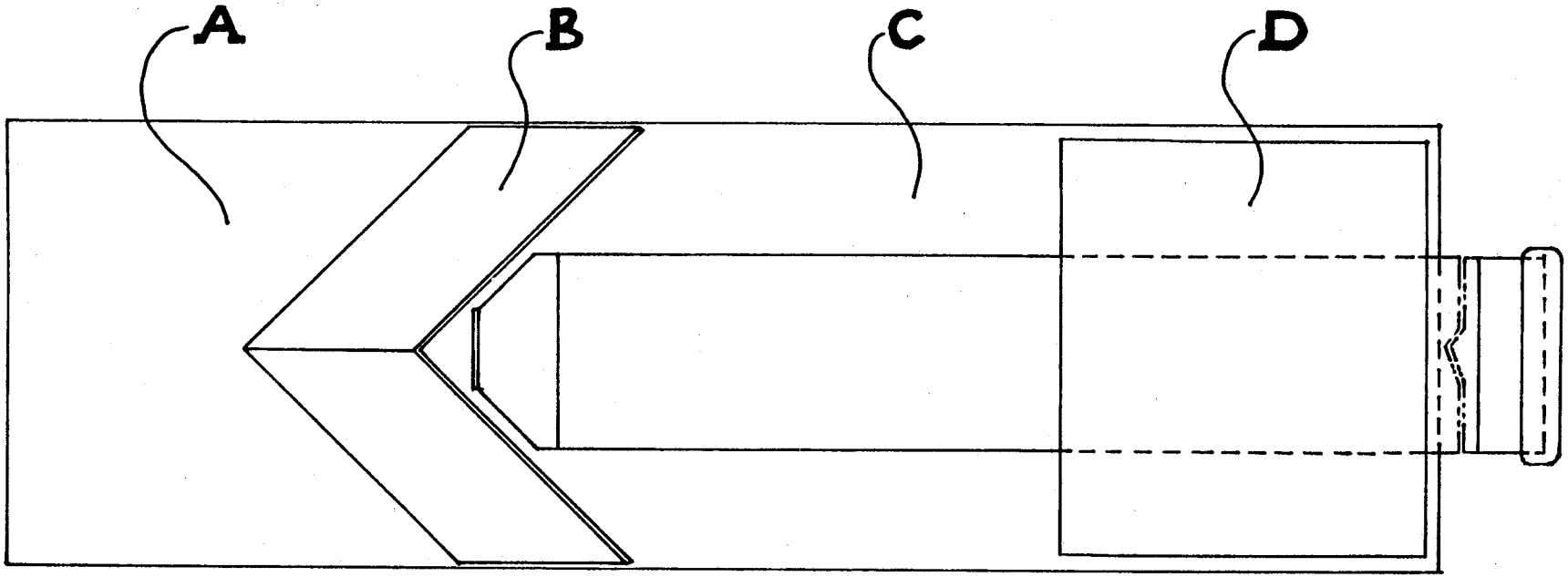
FIG. 1 is a plan view of device
Figure 2:
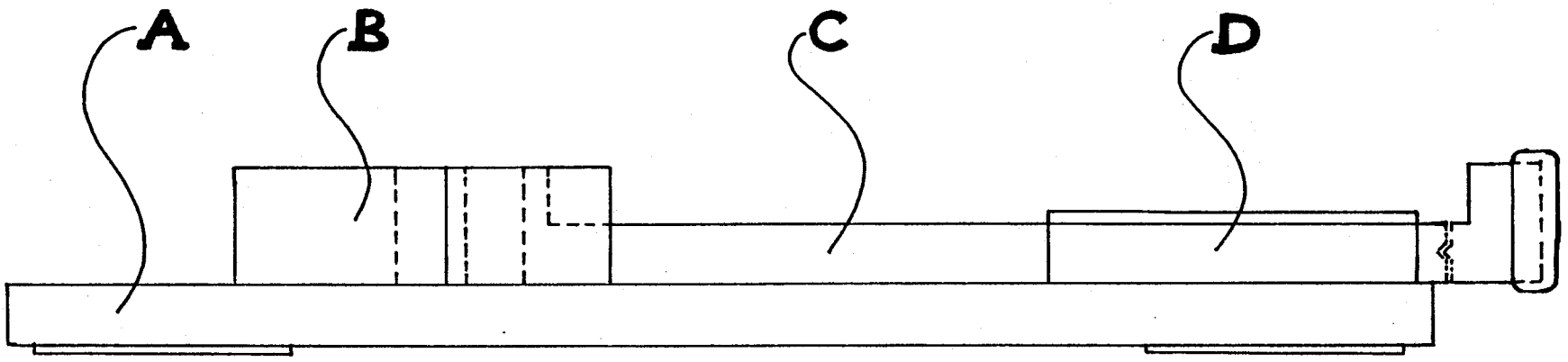
FIG. 2 is a side view of FIG. 1.

The device is placed on a suitable surface to provide support (normally a counter-top). One end must be against the back wall of the counter or suitable support to act as a "stop".

The container to be opened is placed on the base(A) and positioned against the blocks forming a "V"(B).

The pressure contact slider(C) is moved forward until contact is made with the container.

Body pressure is applied to the padded end of the slider(C) which firmly grips the container between the blocks(B) and slider(C).

Contact faces of block(B) and slider(C) are rubber-faced to improve the gripping action.

This leaves one or both hands free to twist, puncture or pry off the container lid or part thereof.

The slider(C) is contained and guided by channel enclosure(D) made up of two side guides and one hold-down plate. The channel is designed with adequate clearance to allow the slider to move freely, yet restrict side and vertical movement created by holding the container while removing the lid.

Eye hooks are provided on the edge of the base to accommodate "out-of-the-way" storage while not in use.

I claim:

1. A device to firmly hold a container while removing the lid (or part thereof), or securing an object to perform a task on it, comprising of:

(a) a base fitted with rubber pads to act as non-slip surfaces when placed on a work counter with one end against a vertical support;

(b) permanently positioned blocks secured to the base to form a "V" (B) to locate the container to be opened;

(c) a channel enclosure comprising two side guides and one hold-down plate (D) firmly fastened to the base plate which locates and guides a pressure contact slider (C) having a gripper end and a padded end;

(d) the gripper end of the pressure slider (C) contacts the outside of the container, securely holding the container against the "V" blocks (B) when body weight is applied directly to the padded end of the pressure slider (C);

(e) gripper surfaces on the "V" blocks (B) and the pressure slider (C) are rubber faced to improve the gripping ability.

2. A device as described in claim 1 wherein containers or objects ranging from approximately one-half inch diameter to approximately six inches in diameter are held firmly while removing the lid from the container, or while performing a task on the object, with no required structural change to the device.

* * * * *